US007624540B1

(12) United States Patent
Hayden et al.

(10) Patent No.: US 7,624,540 B1
(45) Date of Patent: Dec. 1, 2009

(54) STAGE SYSTEM WITH CONNECTABLE CORNER

(75) Inventors: Michael R. Hayden, Edina, MN (US); Danny D. Scott, Princeton, MN (US)

(73) Assignee: Staging Concepts, Inc., Brooklyn Center, MN (US)

( * ) Notice: Subject to any disclaimer, the term of this patent is extended or adjusted under 35 U.S.C. 154(b) by 824 days.

(21) Appl. No.: 10/842,703

(22) Filed: May 10, 2004

Related U.S. Application Data

(60) Provisional application No. 60/469,621, filed on May 9, 2003.

(51) Int. Cl.
*E04H 3/12* (2006.01)

(52) U.S. Cl. ..... 52/6; 52/7; 52/263; 52/282.4; 52/656.9

(58) Field of Classification Search ..... 52/7, 52/64, 79.1, 79.9, 79.12, 127.1, 263, 281, 52/282.1, 282.4, 656.9, 704, 6; 108/186, 108/187, 192, 193; 403/205, 363, 403, 382
See application file for complete search history.

(56) References Cited

U.S. PATENT DOCUMENTS 3,338,012 A * 8/1967 Kappenhagen et al. ..... 52/282.4
3,436,881 A * 4/1969 Schlecht ..... 52/282.1
5,205,087 A * 4/1993 Jines ..... 52/6
5,226,755 A * 7/1993 Tweedt ..... 403/205
5,319,906 A * 6/1994 Hayden ..... 52/7
5,711,230 A * 1/1998 Parsons ..... 108/186
5,848,501 A * 12/1998 Taipale et al. ..... 52/263

* cited by examiner

*Primary Examiner*—Richard E Chilcot, Jr.
*Assistant Examiner*—Matthew J Smith
(74) *Attorney, Agent, or Firm*—Crawford Maunu PLLC

(57) ABSTRACT

A portable platform-support provides an external platform corner for supporting a platform surface structure. The external platform corner employs a rigid corner-support apparatus that is connectable to other components. The rigid corner-support apparatus includes a non-integrating outer-facing portion with opposing outer edges and an inner portion. A channel member has an elongated shape and an upper surface adapted to provide support to the platform surface structure, and a reinforcement member is securely coupled to and extending from the inner portion with the reinforcement member being adapted to securely support the channel member.

34 Claims, 6 Drawing Sheets

STAGE SYSTEM WITH CONNECTABLE CORNER

RELATED PATENT DOCUMENTS

This patent document claims the benefit, under 35 U.S.C. §119(e), of U.S. Provisional Patent Application Ser. No. 60/469,621, filed on May 9, 2003.

BACKGROUND

Stages are designed for a wide variety of applications including, for example, smaller one-step platforms and large risers for auditorium seating applications. Generally, the manufacture, or design, of these stages can be broken down into two categories: fixed and portable. A fixed stage is designed and/or installed for permanency; once installed, there are typically no expectations that the stage is to disassembled or moved. For the portable stage market, however, a good design is typically one that can be assembled, disassembled, expanded (or configured) and reconfigured, easily accessed for repair and movable. The market typically demands that portable stages be easily assembled and disassembled and sufficiently lightweight for moving. For both the fixed and portable stage market, a quality stage is durable for decades of heavy traffic while remaining structurally sound.

In either the fixed or portable markets, reducing the size and weight of each part used in a quality stage can be important for addressing most all of the above-mentioned features of the stage. Minimizing the amount of material used to build the stage can also serve to lessen the overall weight of the stage as well as both labor (e.g., for assembly) and material costs.

For some applications where the portability feature is used relatively frequently, ease of set up and take down can be a priority. Without the ability to easily and quickly be set up and taken down, a stage can lose its versatile character. For example, in certain applications where a stage is expected to be moved only 2-3 times over a given span of time, the labor costs associated with the disassembly and reassembly of the stage can exceed the depreciation-adjusted cost of a new stage when that time span lapses, and the value of the stage's portability can be negated.

A fixed stage benefits from the above-mentioned features in various ways as well. For example, even though reassembly is not expected to occur, if not designed properly, a fixed stage design may require heavy equipment and the associated expensive costs of assembly; thereby driving up the costs for initially assembling the stage. Lightweight fixed-stage components allow for ease of movement which is less rigorous work during the initial stage construction. Simple, lightweight-component construction makes a stage more marketable in view of the less-intensive training needed for the labor to build the stage. Although a fixed stage is intended to remain intact for a period of time, the inevitable discarding of the stage is facilitated by these same features that serve the portable stage market. Moreover, like portable stages, fixed stages become damaged and therefore should be designed with varying degrees of component access for maintenance and repair purposes.

In view of the above, there have been various attempts to provide stage systems and components that attempt to address all of the above features. For a variety of reasons, however, these stage systems and components fail to sufficiently address these above-discussed, and other market-demanded features.

SUMMARY OF THE INVENTION

The present invention is directed to stage assembly methods and stage systems that address the above-discussed and other issues and that provide connectable stage components for realizing many if not all the above-discussed features.

In one embodiment, the present invention is directed to a platform-support system and method. The platform-support system has an external platform corner at which a platform surface structure is supported. The platform corner includes a rigid corner-support apparatus having a non-integrating outer-facing portion with opposing outer edges and having an inner portion. The system also includes a channel member having an elongated shape and an upper surface adapted to provide support to the platform surface structure, and includes a reinforcement member securely coupled to and extending from the inner portion. The reinforcement member securely supports the channel member. In a more detailed embodiment, the above-described system is adapted to provide a portable stage assembly.

In another embodiment of the present invention, a portable platform-support system having a supported platform corner at which a platform surface structure is supported includes a rigid corner-support apparatus having a non-integrated outer-facing portion with opposing outer edges and having an inner facing portion with a planar upper surface extension recessed from an upper portion of the rigid corner-support apparatus, a channel member having an elongated shape and an upper surface adapted to provide support to the platform surface structure, and a reinforcement member securely coupled to and extending from the inner facing portion, the reinforcement member being adapted to securely support the channel member.

In another embodiment of the present invention, a portable platform-support system having a supported platform corner at which a platform surface structure is supported includes a channel member having an elongated shape and a pair of accessory tracks and an upper surface adapted to provide support to the platform surface structure, a rigid corner-support apparatus having an inner portion and a non-integrating outer-facing portion with opposing outer edges having a pair of track couplers along each of the opposing outer edges, and a reinforcement member securely coupled to and extending from the inner portion, the reinforcement member being adapted to securely support the channel member.

In yet another embodiment of the present invention, a portable platform-support system having a supported platform corner at which a platform surface structure is supported includes a channel member having an elongated shape and a pair of accessory tracks and an upper surface adapted to provide support to the platform surface structure, a rigid corner-support apparatus having a non-integrated outer-facing portion with opposing outer edges with a pair of track couplers along each of the opposing outer edges, and having an inner facing portion with a planar upper surface extension recessed from an upper portion of the rigid corner-support apparatus, and a reinforcement member securely coupled to and extending from the inner facing portion, the reinforcement member being adapted to securely support the channel member.

In another embodiment of the present invention, a method for providing an external platform corner at which a platform surface structure is supported is provided and includes, securely coupling a rigid corner-support apparatus having a non-integrating outer-facing portion with opposing outer edges and having an inner portion with a reinforcement member, wherein the reinforcement member extends from the inner portion, and slidably connecting a channel member having an elongated shape and an upper surface adapted to provide support to the platform surface structure with a reinforcement member.

In another embodiment of the present invention, a portable stage deck is provided that includes a plurality of rigid corner-support apparatus, each having a non-integrating outer-facing portion with opposing outer edges and having an inner portion, a plurality of reinforcement members securely coupled to each of the plurality of rigid corner-support apparatus, wherein the each reinforcement member extends from the inner portion, a plurality of channel members having a first and second end, wherein the first end of a channel member is slidably connected to one of the plurality of reinforcement members, and the second end is slidably connected to another of the plurality of reinforcement members, and a platform surface structure supported by the plurality of rigid corner-support apparatus and the plurality of channel members.

The above summary of the present invention is not intended to describe each embodiment or every implementation of the present invention. Advantages and attainments, together with a more complete understanding of the invention, will become apparent and appreciated by referring to the following detailed description and claims taken in conjunction with the accompanying drawings.

Figures 1A, 1B:
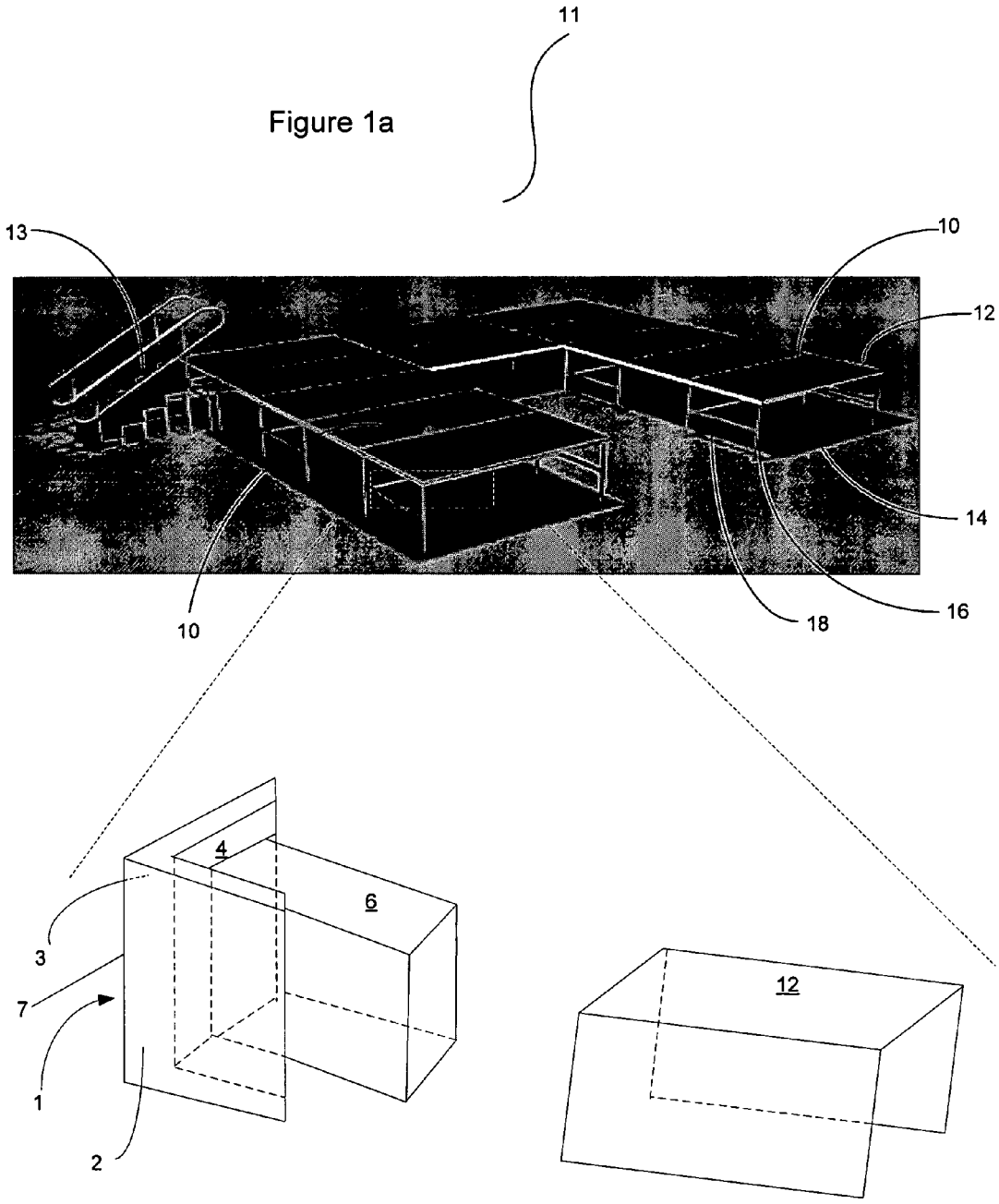
FIG. 1*a* illustrates an assembled stage with a C-shaped floor plan which can be incorporated with embodiments of the present invention.
FIG. 1*b* illustrates a blown-out view of a corner of the stage assembly illustrated in FIG. 1*a*.

While the invention is amenable to various modifications and alternative forms, specifics thereof have been shown by way of example in the drawings and will be described in detail. It should be understood, however, that the intention is not necessarily to limit the invention to the particular embodiments described. On the contrary, the intention is to cover all modifications, equivalents, and alternatives falling within the spirit and scope of the invention as defined by the appended claims.

DESCRIPTION OF THE DRAWINGS

The present invention is believed to be applicable to a variety of different types of stages, and has been found to be particularly suited for portable stages. While the present invention is not necessarily limited to such devices, various aspects of the invention may be appreciated through a discussion of various examples using this context.

One embodiment of the present invention is directed to a stage that includes external platform corners having corner supports coupled to reinforcement members and side frames which can secure to decking, and posts. Side frames, also referred to as channel members, secure to reinforcement members coupled to corner supports to form the stage frame. A portion of the external edges of the corner supports are exposed in the assembled stage frame. The assembled stage frame supports the decking via side frames, corner supports, or both. Vertical supports connect to the corner supports adding the desired height to the stage. Vertical supports such as posts can be stabilized using horizontal supports, for example.

In accordance with the present invention, the exposed portion of the corner support includes outer-facing rigid walls and provides the stage frame with added durability because the exposed corners are made of one piece of metal and portions of the corners are reinforced to lessen the chance that the corners will bend or break apart when subjected to heavy use and transport. The increased durability of the stage frame increases the overall durability of the stage, thereby increasing stage quality.

In another embodiment of the present invention, side frames and rigid corners-support pieces provide protection for the sides of the decking and support the decking laterally by recessing the decking below a portion of the outside edges of the side frames and external platform corners.

In another implementation of the present invention, external corner-support pieces can be constructed so that the height of the external corner is tall enough for the decking to be recessed while the side frames can be constructed without deck recessing capabilities. Corner supports provide lateral and vertical support for decking and side frames provide vertical support for the decking.

In another implementation of the present invention, external corner-support pieces are used to secure decking to the stage frame by forming a cradle, wherein the deck is secured to the assembled stage frame from the bottom, sides and top.

In a similar implementation of the present invention, decking can be secured to the stage frame using locking members. The locking members lock the decking to the external corner-support pieces, side frames or both.

In yet another implementation of the present invention, decking can be secured laterally to the stage frame by extending members. The extending members can extend from external corner-support pieces, side frames, or decking.

In a substantially similar implementation of the present invention, adhesive material laterally secures the decking material to the side frames, external corner-support pieces, or both.

In another implementation of the present invention, friction bonding material on the external corner-support pieces, side frames, or both laterally secures the deck to the stage frame.

Combinations of the above-mentioned embodiments of the present invention can also be integrated to form further embodiments of the present invention.

FIG. 1*a* illustrates an embodiment of an assembled stage 11 which can be constructed in accordance with embodiments of the present invention. Assembled stage 11 is constructed in a C-shaped deck plan having stairway 13. Because the assembled stage 11 includes multiple individual portable stage decks 10 which can be configured in a variety of ways, the deck plan depicted in FIG. 1*a* is one of many possible configurations that assembled stage 11 may take. Each portable stage deck 10 includes a rigid deck 14 supported by channel members 12. The channel members 12 can be supported by corner-support pieces 1, vertical supports 16 and horizontal supports 18 or can be supported by bridging one portable stage deck 10 with another portable stage deck 10. In addition to incorporating stairway 13 with assembled stage 11, the assembled stage 11 can also include hand railings, ramps, chairs and risers, for example.

A blown-out view of a corner of a portable stage deck 10 from FIG. 1*á* is illustrated in FIG. 1*b*. The corner portion of the stage deck includes a rigid corner-support piece 1 having outer facing walls 2 and 3 (hidden), and an inner portion 4. The outer-facing walls 2 and 3 join to form an apex 7. Outer-facing walls of the rigid corner-support piece have a non-integrating character that allows for a portable stage deck to be situated adjacent to other portable stage decks while not locking to the other decks at the corners. Channel member 12 having an elongated shape and upper surface is joined with the corner-support piece 1 via reinforcement member 6. Channel member 12 provides support to the portable stage deck. Reinforcement member 6 securely couples to the corner-support piece 1 and extends from the inner portion 4 of the corner-support piece 1. Reinforcement member provides support to channel member 12 and thus provides support to the portable stage deck.

Figure 2A:
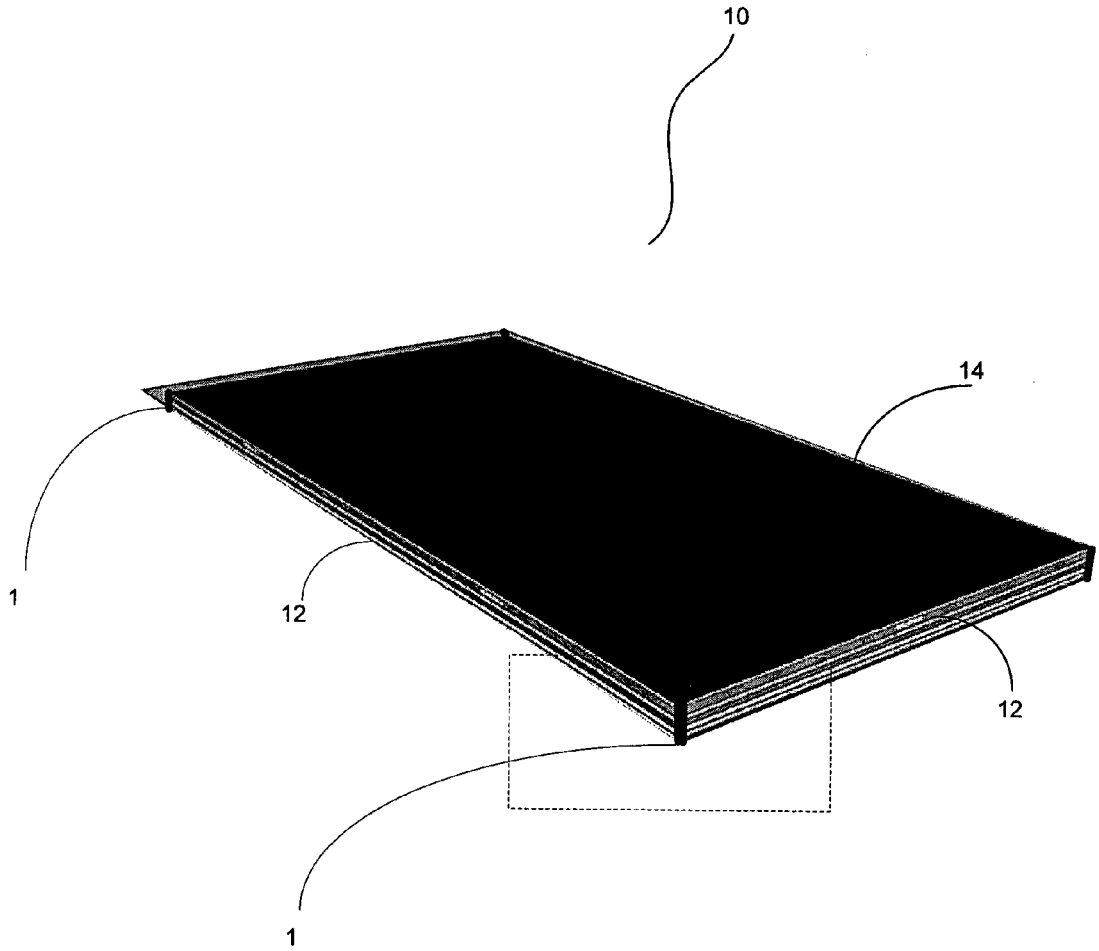
FIG. 2*a* illustrates a top view of a portable stage deck usable in accordance with embodiments of the present invention.

FIG. 2*a* illustrates a top view of the portable stage deck 10 with corner-support pieces 1, channel member 12 and a rigid deck 14 which can be used in accordance with embodiments of the invention.

Figure 2B:
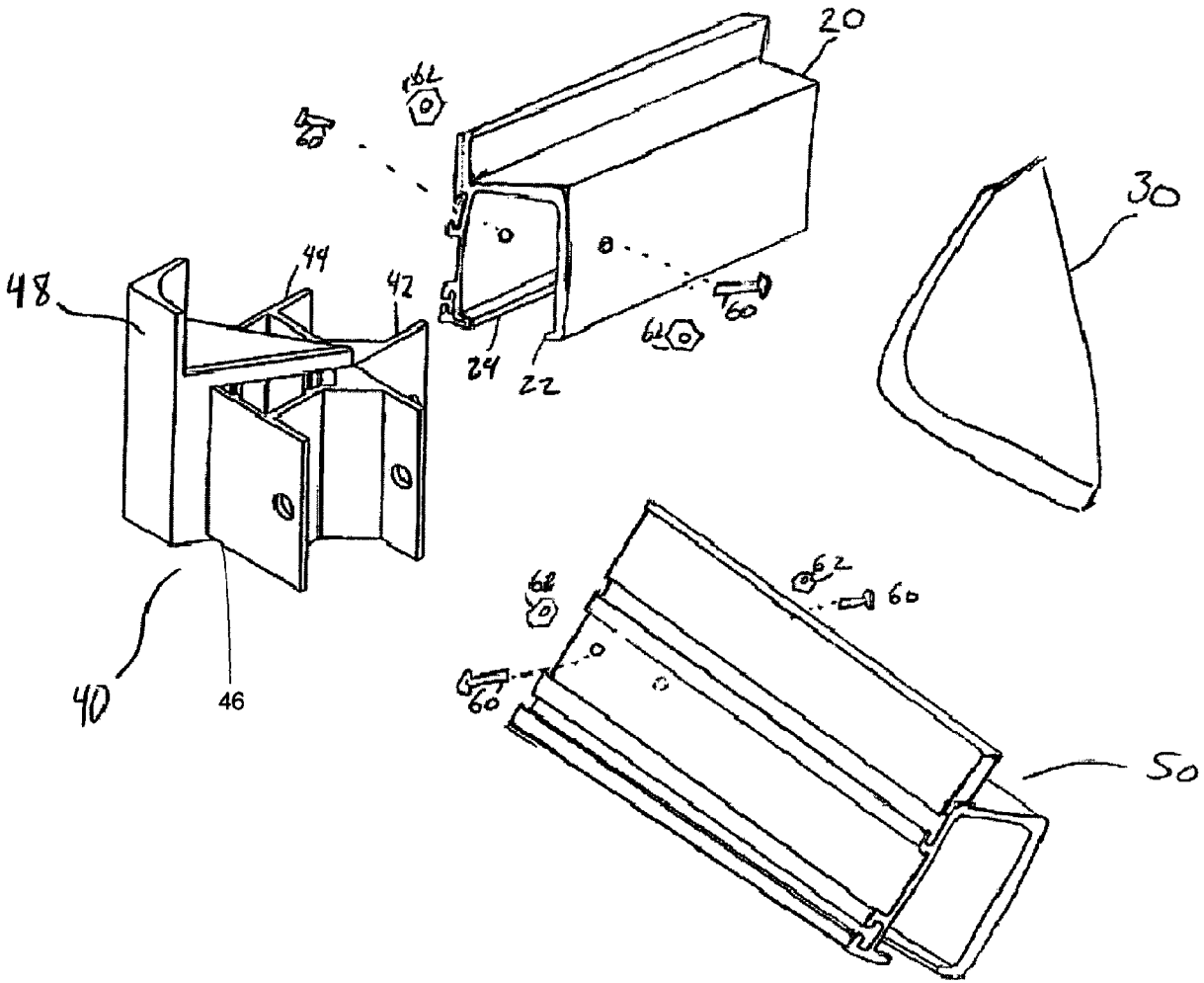
FIG. 2*b* illustrates a blown-out view of a corner of the stage assembly illustrated in FIG. 2*a* in accordance with embodiments of the present invention.

FIG. 2*b* shows an expanded view of a corner of portable stage deck 10 illustrated in FIG. 2*a* which can be constructed in accordance with embodiments of the present invention. The expanded view of the portion of portable stage deck 10 includes channel members 20 and 50, rigid deck 30, and corner support piece 40. Channel member 20 includes a female connecting portion shown as internal guiding walls 22 and 24 that engages with and secures to the male attachment portions of reinforcement members 42 and 44. Reinforcement members 42 and 44 can include flanges having machined holes for securing channel member 20 that allows secure coupling to corner support piece 40. For example, channel member 20 can be secured to corner support 40 by drilling holes in channel member 20 and, when needed, the reinforcement members 42 and 44 can be securely coupled to support piece 40, and by passing connectors 60 through the holes and attaching a securing device 62 to the connectors 60. Channel member 50 is secured to in a similar manner. Upon securing channel members 20 and 50 to corner support piece 40, external corner 48 remains exposed. The under-side of corner support piece 40 further includes an elevating portion 46 that can take the form of a female portion for accepting elevating members such as posts.

In embodiments of the invention, external corner 48 and channel members 20 and 50 protect the horizontal edges of rigid deck 30 and laterally secure stage deck 10. The rigid deck 30 can be made of various materials including plywood, fiberglass, natural wood, tongue and groove flooring and polypropylene. Corner support piece 40 can be made of cast metal, for example. The corner support piece 40 can protect the edges of channel member 20 because, rather than forming corners using the edges of channel members 20 and 50, external corner 48 is positioned at each corner of portable stage deck 10. Corner support piece 40 increases the durability of the portable stage deck 10 because, for example, corner support piece 40 can be fabricated from one piece of cast metal instead of from channel members 20 and 50 cut at 45-degree angles.

Figure 3:
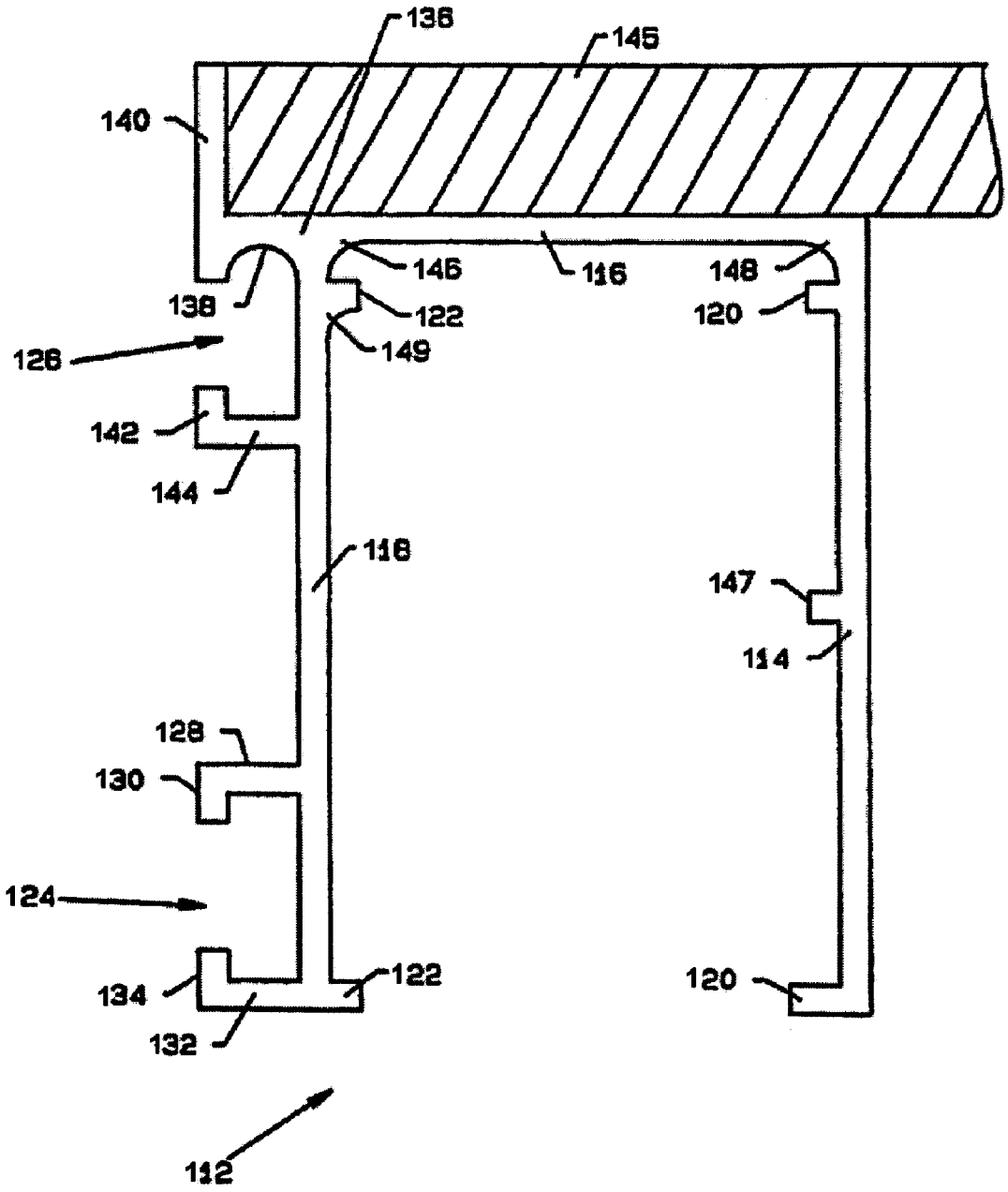
FIG. 3 illustrates a channel member which can be used in accordance with embodiments of the present invention.

FIG. 3 illustrates an end view of a channel member 112 that can be included in portable stage deck 10. Channel member 112 can be fabricated in a variety of ways including extrusion and milling processes. The channel member 112 includes, for example, an inner wall member 114, a connecting upper wall member 116, an outer wall member 118, lip members 120 and 122, and slotted channel members 124 and 126.

Slotted channel member 124 is formed by right angle members having a horizontally oriented member 128 and vertically oriented member 130 pair, and by a horizontally oriented member 132 and vertically oriented member 134 pair in conjunction with the outer wall member 118. The slotted channel member 126 is similarly formed with the exception of the top member 136, which, at its upper region, has a support arch 138 at the lower junction of the top wall member 116, a vertical member 140 and the outer wall member 118. The lower portion of the slotted channel member 126 is formed by a vertically oriented member 142 and a horizontally oriented member 144 extending from the outer wall member 118. A portion of the wall 118 forms part of the slotted channel member 126. The slotted channel members together form a pair of accessory tracks for use in accessorizing the portable stage deck.

A support arch 146 bridges the junction of the top wall member 116 and the outer wall member 118. A support arch 148 bridges the junction of the top wall member 116 and the inner wall member 114. Lip member 122 includes an arch support 149. A lip member 147 extends along the inner surface of the inner wall member 114.

A top member 145 butts up to the vertical member 140, which serves as a protective member for the edge of the top member 145. Protection of the edge is especially significant when the platform members are stacked vertically for storage. The particular size of each component is determined by the particular application, and can be extruded from an aluminum alloy.

Figure 4:
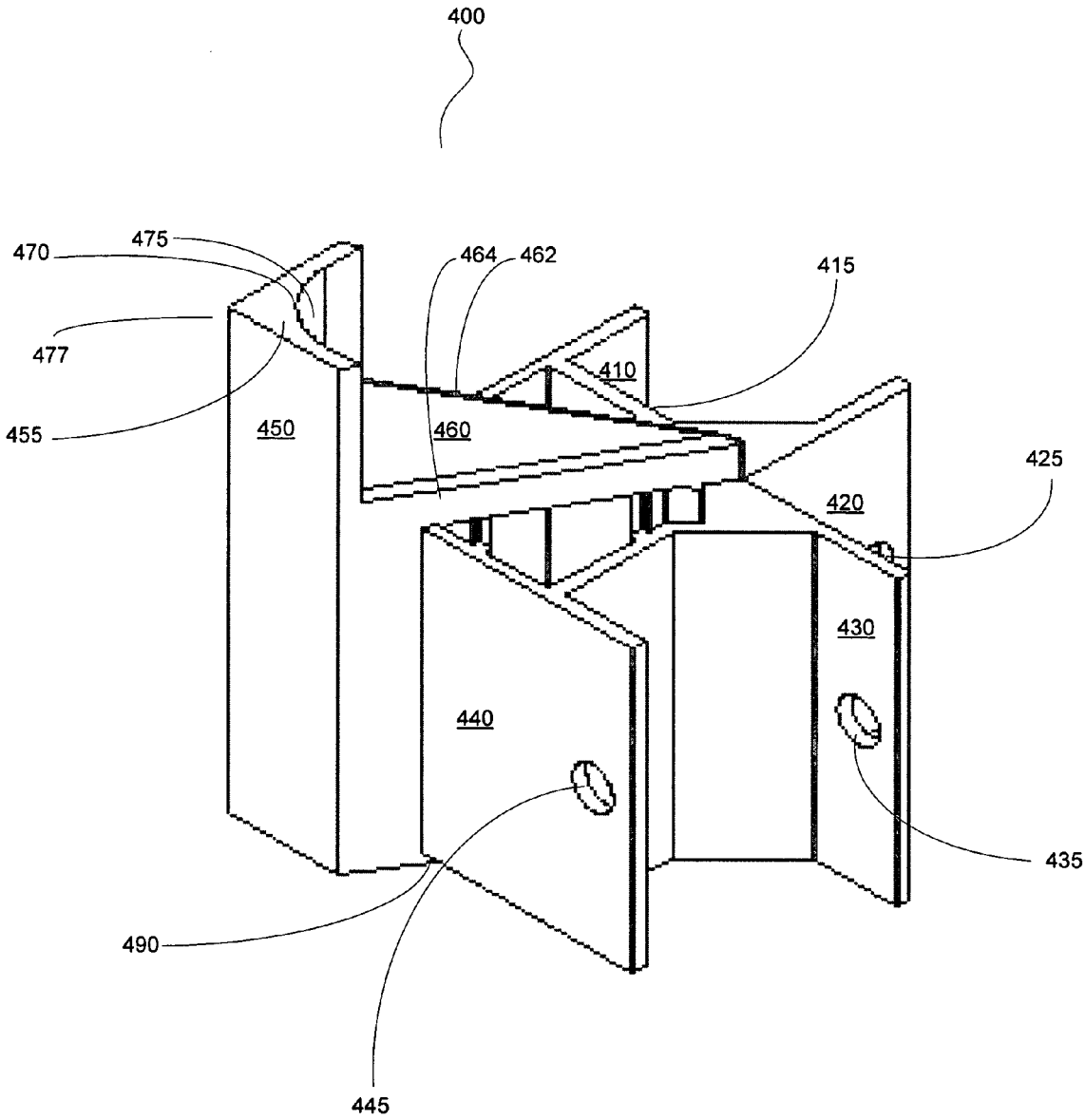
FIG. 4 illustrates a corner support in accordance with embodiments of the present invention.

FIG. 4 illustrates a portion of an external platform corner including corner support 400 having reinforcement members 410, 420, 430, and 440, outer facing portion 450, planar surface 460, an inner portion 470, and an elevating portion 490 for accepting elevating members. Corner support 400 can be made of cast metal and machined to a desired shape and can be cast either with or without connector holes 415 (hidden), 425, 435, and 445. If constructed without connector holes 415, 425, 435, and 445, corner support 400 can have said holes drilled into reinforcement members 410, 420, 430, and 440 before incorporation into a portable stage assembly.

Reinforcement members 410 and 420 accept one end of a first channel member (not shown) and reinforcement members 430 and 440 accept one end of a second channel member (not shown). When reinforcement members 410 and 420 are inserted into a first channel member, the first channel member is secured to the reinforcement members using connector holes 415 and 425, for example. Similarly, reinforcement members 430 and 440 are inserted into a second channel member, and are secured to the channel member using connector holes 435 and 445, for example. External corner 450 having opposing outer walls will remain exposed upon securing the first and second channel members to reinforcement members coupled to corner support 400. External corner 450 includes opposing walls that can be smooth, have cut-out portions, or have members attached thereto.

Planar surface 460 is recessed from a top portion 455 of corner support 400, and inset from an inner portion 470 of the corner support. Planar surface 460 can be exposed when corner support 400 is incorporated with first and second channel members. For example, first and second channel members are cut to an angle which enables the ends of the channel members to rest against corner walls 462 (hidden) and 464 to form a rigid stage frame. Thus, planar surface 460 can provide support for decking surface alone or in combination with channel members.

Inner portion 470 of corner support 400 can include a reinforcing wall that is formed as a reinforcing arch 475, for example. A reinforcing arch 475 allows corner support 400 to be durable and strong. This is because the reinforcing arch 475 will be fabricated with more material than compared to a 90-degree internal retaining wall of the same size because the apex 477 of platform retaining support wall 470 will be reinforced with a larger volume of material, such as cast metal, where the internal retaining wall 475 is rounded.

Figure 5:
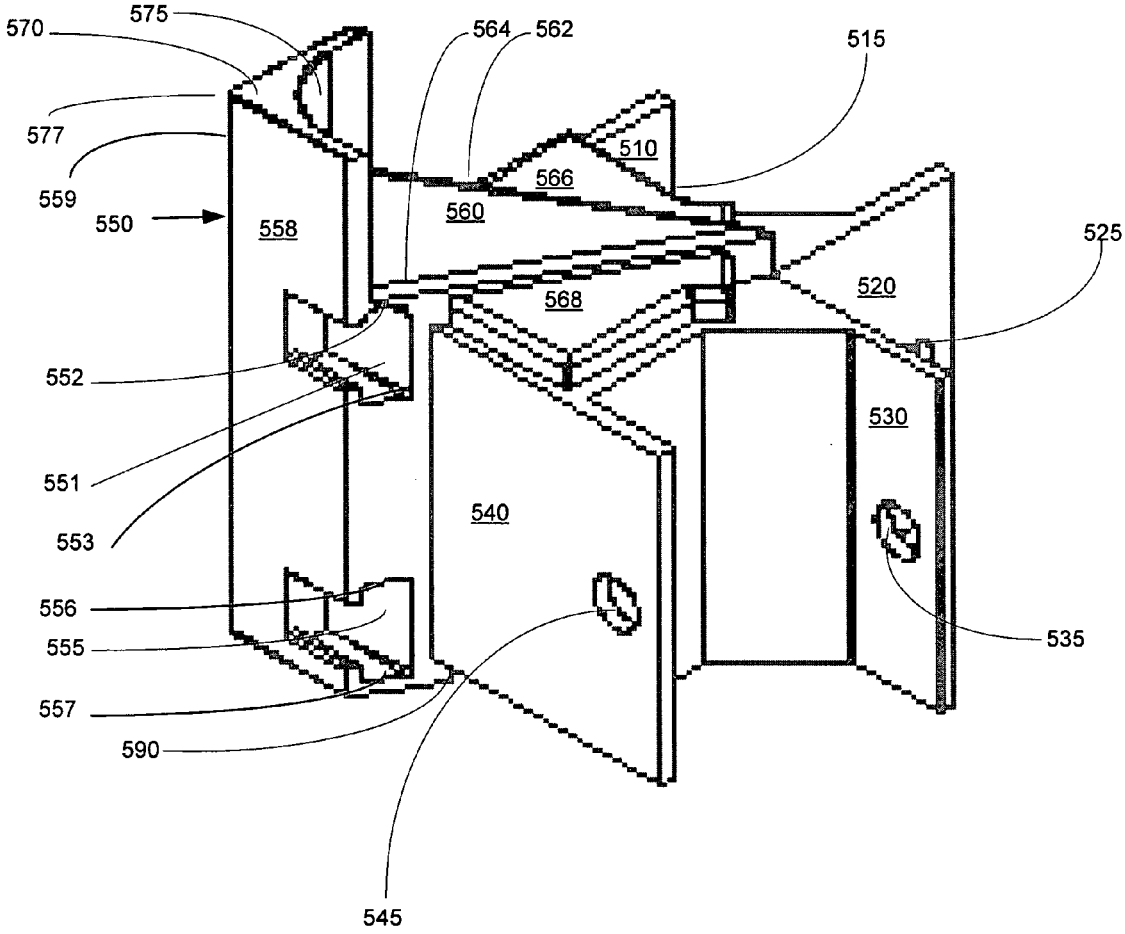
FIG. 5 illustrates another corner support in accordance with embodiments of the present invention.

FIG. 5 illustrates yet another embodiment of a corner support 500 in accordance with embodiments of the present invention. Similar to the embodiment described above, the corner support includes inner portion 570 having a reinforcing arch 575 and an external support wall 550. The support wall in this embodiment, however, includes two outer facing planar surfaces 558 and 559 (hidden), each of which include recessed pockets 551 and 555 (hidden on the 559 surface). As can be seen in the illustration, both pockets extend towards the apex 577 of the support wall 550, where the apex 577 is formed at the point where the two outer facing planar surfaces join. The pockets can be aligned with accessory tracks found on the above-described channel members. For example, recessed pocket 551 includes a supporting arch 552 and a squared off portion 553 which matches-up with a similar accessory track referred to as slotted channel member in FIG. 3. The recessed pockets matching and aligning with channel member slots facilitates retrofitting of accessories used in combination with portable stage deck 10. Similarly, recessed pocket 555 includes two squared off portions 556 and 557 which matches-up with a similar accessory track found on the channel members. Recessed pockets can be located on one or both sides of the two outer facing planar surfaces 558 and 559.

Additionally, planar surface 560 is flanked by recessed planar surfaces 566 and 568. Planar surfaces 566 and 568 provide for further securing support for channel members (not shown). Channel members are cut at an angle complementary to the angles of planar surface walls 562 and 564. Channel members can thus be laterally supported by planar surface walls 562 and 564, vertically supported by planar surfaces 566 and 568, and laterally and vertically supported by flanges 510, 520, 530 and 540. Channel members can be secured to the corner support by fastening to fastener holes 515, 525, 535 and 545. The under-side of the corner support further includes a female elevating portion 590 for accepting elevating members such as posts.

In embodiments of the invention, the top members of channel members are flush with planar surfaces of corner supports on a portable stage deck. Such a configuration allows both channel members and corner supports to provide support for a platform surface. Alternatively, one or more channel members of a portable stage deck can be recessed below the planar surface of a corner support, such that a platform is supported by the higher elevated planar surfaces of corner supports or from channel members not recessed below the planar surface of the corner supports. In contrast, planar surfaces of the corner supports can be recessed below the top members of the channel members, such that channel members provide support to the platform surface.

The various embodiments described above are provided by way of illustration only and should not be construed to limit the invention. Based on the above discussion and illustrations, those skilled in the art will readily recognize that various modifications and changes may be made to the present invention without strictly following the exemplary embodiments and applications illustrated and described herein. Such changes may include, but are not necessarily limited to: fabricating the corner support using a rubber mold, or through forging, or sand casting followed by a finishing process, or by using powder metal. Such modifications and changes do not depart from the true spirit and scope of the present invention that is generally set forth in the following claims:

What is claimed is:

1. A portable platform-support system having an external platform corner at which a platform surface structure is supported, the platform system comprising:

a rigid corner-support apparatus having an inner facing portion configured to receive an underlying support article and an outer-facing portion with opposing outer surfaces configured to face and abut a facing surface of another structure, the opposing outer surfaces each having a recessed pocket;

a channel member having an elongated shape and an upper surface configured to provide support to the platform surface structure; and a reinforcement member securely coupled to and extending from the inner portion, the reinforcement member being configured to securely support the channel member.

2. The portable platform-support system of claim 1, wherein the underlying support article is an elevating member configured to support the platform surface structure.

3. The portable platform-support system of claim 1, wherein the opposing outer surfaces of the rigid corner-support apparatus are configured to remain exposed upon securing the channel member to the reinforcement member.

4. The portable platform-support system of claim 1, wherein the inner facing portion further includes a reinforcing wall having an arch, the reinforcing wall configured to provide lateral support for the platform surface structure.

5. The portable platform-support system of claim 1, wherein the opposing outer surfaces of the outer-facing portion join to form a centrally located apex.

6. The portable platform-support system of claim 1, wherein both the rigid corner-support apparatus and the channel member are configured to directly contact and support the platform surface structure.

7. The portable platform-support system of claim 1, wherein the reinforcement member includes a male connecting portion configured to receive and secure the channel member.

8. The portable platform-support system of claim 1, wherein the channel member includes a female connecting portion configured to receive and secure the reinforcement member.

9. The portable platform-support system of claim 1, wherein the rigid corner-support apparatus further includes a rigid member extending from the inner facing portion and having a planar upper surface recessed below an upper surface of the rigid corner-support apparatus and configured to support the platform surface structure.

10. The portable platform-support system of claim 1, wherein the reinforcement member includes flanges that extend away from the inner facing portion.

11. A portable platform-support system having a supported platform corner at which a platform surface structure is supported, the platform system comprising:

a rigid corner-support apparatus having an outer-facing portion with opposing outer surfaces and having an inner facing portion with a planar upper surface extension recessed from an upper portion of the rigid corner-support apparatus, the inner portion configured to receive an underlying support article, wherein the opposing outer surfaces are configured to face and abut a facing surface of another structure and the opposing outer surfaces each have a recessed pocket;

a channel member having an elongated shape and an upper surface configured to provide support to the platform surface structure; and a reinforcement member securely coupled to and extending from the inner facing portion, the reinforcement member being configured to securely support the channel member.

12. The portable platform-support system of claim 11, wherein the underlying support article in an elevating member configured to support the platform surface structure.

13. The portable platform-support system of claim 11, wherein the opposing outer surfaces of the rigid corner-support apparatus are configured to remain exposed upon securing the channel member to the reinforcement member.

14. The portable platform-support system of claim 11, wherein the upper portion of the rigid corner-support apparatus is a reinforcing wall having an arch, the upper portion of the rigid corner-support apparatus configured to provide lateral support for the platform surface structure.

15. The portable platform-support system of claim 11, wherein the opposing outer surfaces of the outer-facing portion join to form a centrally located apex.

16. The portable platform-support system of claim 11, wherein both the planer upper surface extension and the channel member are configured to directly contact and support the platform surface structure.

17. The portable platform-support system of claim 11, wherein the reinforcement member includes a male connecting portion configured to receive and secure the channel member.

18. The portable platform-support system of claim 11, wherein the channel member includes a female connecting portion configured to receive and secure the reinforcement member.

19. The portable platform-support system of claim 11, wherein the reinforcement member includes flanges that extend away from the inner facing portion.

20. The portable platform-support system of claim 11, wherein the planar upper surface extension extends above the reinforcement member.

21. A portable platform-support system having a supported platform corner at which a platform surface structure is supported, the platform system comprising:

a channel member having an elongated shape and a pair of accessory tracks and an upper surface adapted to provide support to the platform surface structure;

a rigid corner-support apparatus having an inner facing portion and a non-integrating outer-facing portion with opposing outer edges having a pair of track couplers along each of the opposing outer edges, the inner facing portion including a reinforcing wall having an arch, the reinforcing wall configured to provide lateral support for the platform surface structure, and the inner facing portion including a planar upper surface extension that is recessed from the reinforcing wall and that is configured to directly contact and support the platform surface structure; and a reinforcement member securely coupled to and extending from the inner portion, the reinforcement member being adapted to securely support the channel member.

22. The portable platform-support system of claim 21, wherein the opposing outer surfaces of the rigid corner-support apparatus are configured to remain exposed upon securing the channel member to the reinforcement member.

23. A portable platform-support system having a supported platform corner at which a platform surface structure is supported, the platform system comprising:

a channel member having an elongated shape and a pair of accessory tracks and an upper surface adapted to provide support to the platform surface structure;

a rigid corner-support apparatus having a non-integrated outer-facing portion with opposing outer edges with a pair of track couplers along each of the opposing outer edges, and having an inner facing portion with a planar upper surface extension recessed from an upper portion of the rigid corner-support apparatus, the upper portion being a reinforcing wall having an arch and the reinforcing wall is configured to provide lateral support for the platform surface structure; and a reinforcement member securely coupled to and extending from the inner facing portion, the reinforcement member being adapted to securely support the channel member.

24. The portable platform-support system of claim 23, wherein the opposing outer edges of the rigid corner-support apparatus are configured to remain exposed upon securing the channel member to the reinforcement member.

25. A portable platform-support system having a supported platform corner at which a platform surface structure is supported, the platform system comprising:

a rigid corner-support apparatus having a non-integrated outer-facing portion with opposing outer surfaces each having a recessed pocket and having an inner facing portion with a planar upper surface extension recessed from an upper portion of the rigid corner-support apparatus and configured to receive an underlying support article, the opposing outer surfaces configured to face and abut a facing surface of another structure;

a channel member having an elongated shape, an upper surface configured to provide support to the platform surface structure and an elongated slot configured to align with one of the recessed pockets; and a reinforcement member securely coupled to and extending from the inner facing portion, the reinforcement member configured to securely support the channel member.

26. The portable platform-support system of claim 25, wherein the underlying support article is an elevating member configured to support the platform surface structure.

27. The portable platform-support system of claim 25, wherein the opposing outer edges of the rigid corner-support apparatus are configured to remain exposed upon securing the channel member to the reinforcement member.

28. The portable platform-support system of claim 25, wherein the upper portion of the rigid corner-support apparatus is a reinforcing wall having an arch, the upper portion configured to provide lateral support for the platform surface structure.

29. The portable platform-support system of claim 25, wherein the opposing outer edges of the outer-facing portion join to form a centrally located apex.

30. The portable platform-support system of claim 25, wherein both the planar upper surface extension and the channel member are configured to directly contact and support the platform surface structure.

31. The portable platform-support system of claim 25, wherein the reinforcement member includes a male connecting portion configured to receive and secure the channel member.

32. The portable platform-support system of claim 25, wherein the channel member includes a female connecting portion configured to receive and secure the reinforcement member.

33. The portable platform-support system of claim 25, wherein the reinforcement member includes flanges that extend away from the inner facing portion.

34. The portable platform-support system of claim 25, wherein the planar upper surface extension extends above the reinforcement member.

* * * * *